United States Patent [19]

Roth

[11] 4,200,965

[45] May 6, 1980

[54] ROTARY STRIPPER

[75] Inventor: Robert B. Roth, New York, N.Y.

[73] Assignee: Coastal Abrasive & Tool Company Inc., Trumbull, Conn.

[21] Appl. No.: 935,258

[22] Filed: Aug. 21, 1978

[51] Int. Cl.[2] ..... B21C 43/00; B23D 79/12; B23P 25/00

[52] U.S. Cl. ..... 29/81 J; 51/334

[58] Field of Search ..... 29/81 R, 81 G, 81 J, 29/81 L, 81 H; 15/236 R, 236 B, 236 C, 159 A, 77, 78, 200; 30/172; 17/18, 64; 26/31; 125/5; 51/334

[56] References Cited

U.S. PATENT DOCUMENTS 1,694,018 12/1928 Mudge et al. ..... 15/198 X

FOREIGN PATENT DOCUMENTS 530654 7/1931 Fed. Rep. of Germany ..... 125/5

*Primary Examiner*—Wayne L. Shedd

*Attorney, Agent, or Firm*—Ostrolenk, Faber, Gerb & Soffen

[57] ABSTRACT

A rotary stripper comprising a pair of spaced plates driven around a shaft and studs extending between the plates and radially spaced from the shaft; stripper members, each comprising generally hairpin shaped members, with the bend mounted around a stud and the legs extending past the shaft and beyond the periphery of the plates; the legs of each stripper member are respectively supported against excessive deflection by the drive shaft and on the other studs; retainer studs are provided radially outside the mounting studs to block separation of the stripper members from their respective mounting studs; the stripper members are laid down on annularly successive studs until the required height of the stripper is reached, whereby the stripper members are interleaved.

16 Claims, 5 Drawing Figures

FIG. 1
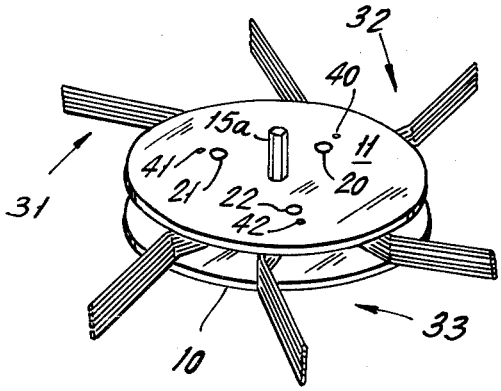
FIG. 3
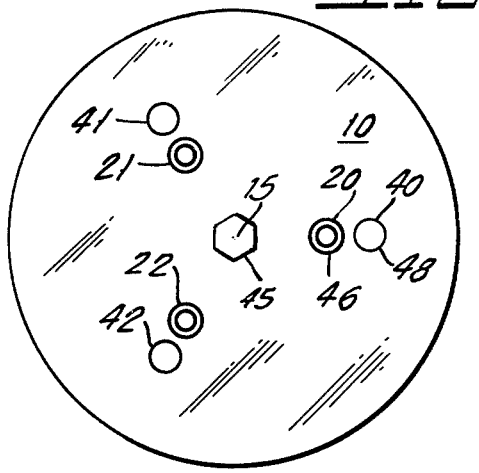
FIG. 2
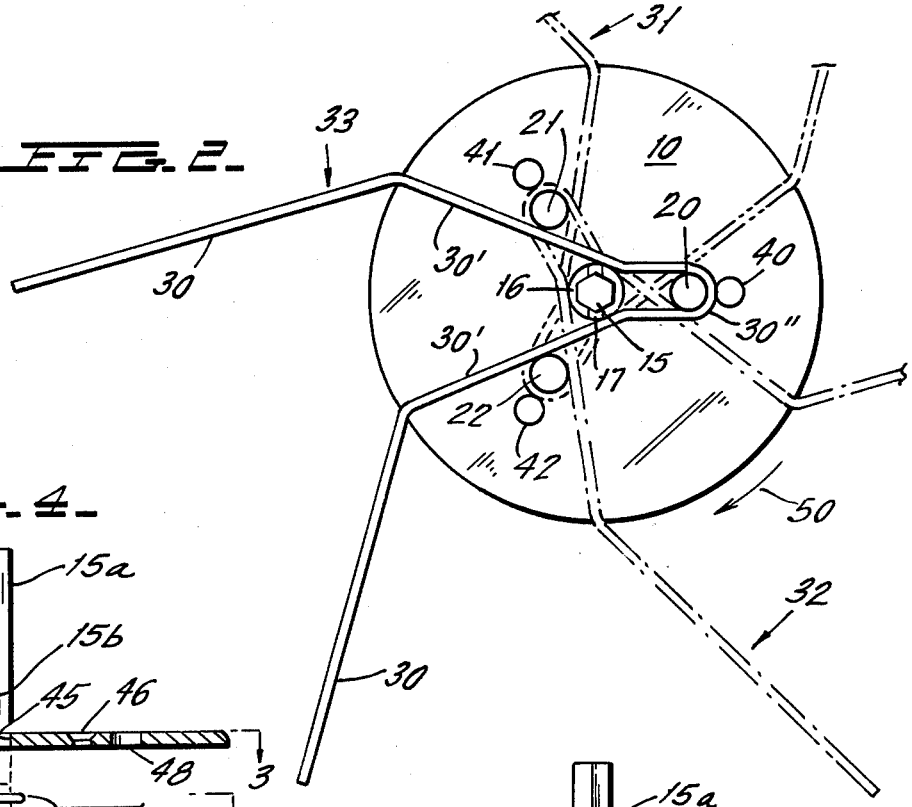
FIG. 4
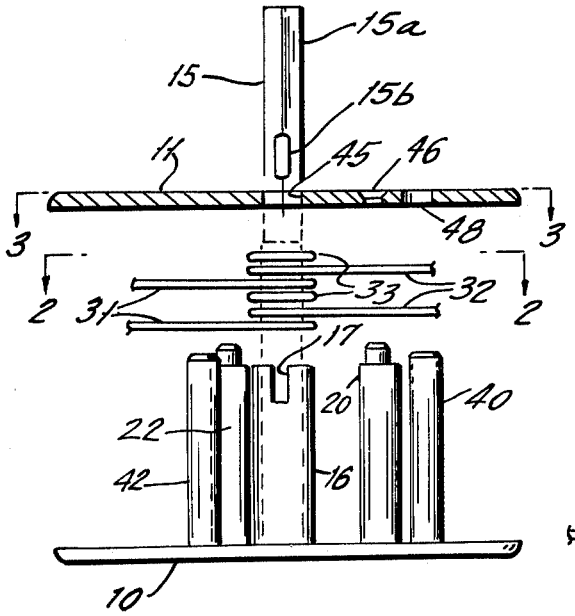
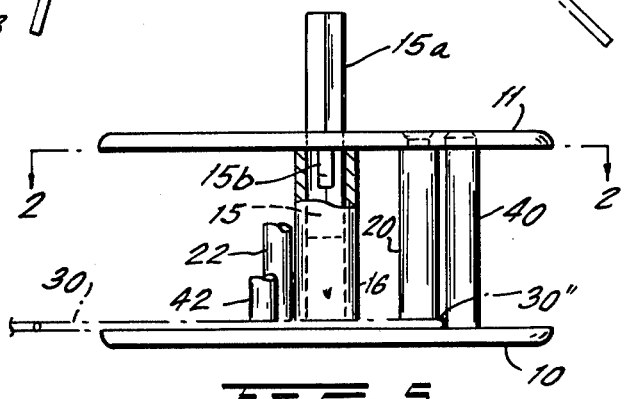
FIG. 5

ROTARY STRIPPER

The present invention relates to strippers and more particularly to rotary strippers of the type which may be placed in the chuck of a hand held drill, or the like tool and be rotated in order to scrape, strip or abrade a surface to remove paint, rust or other deposits thereon.

BACKGROUND OF THE INVENTION

Heretofore in the construction of rotary strippers a number of stripping elements or blades have been supported to extend radially from supports arranged around a central hub. The hub has a shaft which may be connected to the chuck of a hand drill.

In most cases, the stripping elements comprised separate fingers, which were supported individually on studs that extend between opposed plates that defined the hub. The fingers have been arranged so that they may deform themselves or bend or swivel to yield somewhat to the pressures exerted thereon. At times, comb constructions i.e. a plurality of parallel fingers arranged in a row and projecting from a common base, have been used for defining the plurality of fingers. In every previous case, the problems have been complicated assembly, interconnection of the parts and breakage of the fingers during use of the scraper. This has also included the construction of supports for the rotating fingers or of the fingers themselves in such manner as to permit the fingers to yield rather than to break.

One of the major problems, however, has been that the fingers must be separately oriented and separately arranged and held appropriately in the stripper or scraper.

SUMMARY OF THE INVENTION

The present invention contemplates the utilization of spring wire members each consisting of two legs mounted in such a manner that six individual stripping fingers, in three sets of two fingers each, will be formed by three spring wire members. Essentially, each spring wire member is formed similar in shape to a hairpin. The legs of the member are bent in a direction to trail the direction of rotation of the scraper in use. Each spring wire member includes a central, quite sharp bend and the bend is mounted over a stud.

In assembling a device of this character, there is a base plate having three or more principal spring wire member supporting studs that are uniformly spaced apart, 120° C. for three studs, and the studs are appropriately spaced from the center of the base plate. The principal studs are backed up by additional retaining studs as hereinafter described. The base plate has an upstanding centrally located driving element secured thereto, rotation of which rotates the plate.

A series of the double leg spring wire stripping members are than laid down sequentially on the base plate. The first spring wire stripping member is laid on one stud. Its legs extend from the stud, past the central rotation shaft of the base plate, to extend outside the periphery of the base support plate. The second spring wire stripping member is laid on the next stud 120° removed and its legs also extend out beyond the periphery of the base support plate. The third spring wire stripping member is laid on the last stud 120 ° removed. The fourth spring wire stripping member is laid on the original stud, and so on with the other spring wire stripping members continuously around the studs until the full set of fingers, as determined by the height of the studs, is completed. Then a retaining plate is secured in position over the studs, and any appropriate hub is provided.

The retaining studs which are just outside the main supporting studs, do not block access for emplacing the wire stripping members because the placement of the fingers is made before a covering or retaining plate is placed over the free ends of the stud.

It is an object of the present invention, therefore, to provide a novel stripper or scraper which is easily assembled.

It is another object of the invention to provide a stripper with a larger number of stripping fingers using a smaller number of parts.

It is a further object of the invention to provide such a stripper wherein the fingers have desirable yieldability.

BRIEF DESCRIPTION OF THE DRAWINGS

The foregoing and other objects and features of the present invention will become apparent from the following description and drawings in which:

FIG. 1 is a perspective view of one form of the stripper of the present invention.

FIG. 2 is a schematic view which shows the method by which successive spring wire stripping members are mounted on the studs, this view being taken from line 2—2 of FIGS. 4 and 5.

FIG. 3 is a top view of a stripper before final securement of the parts taken from the line 3—3 of FIG. 4.

FIG. 4 is an exploded cross-sectional, side view of the stripper.

FIG. 5 is a cross-sectional, assembled side view of the stripper with only one spring wire stripping member illustrated.

DESCRIPTION OF A PREFERRED EMBODIMENT

Referring to the Figures, the stripper or scraper of the present invention comprises a pair of plates 10 and 11. Plate 10 is referred to as the lower plate as a matter of convenience. The two plates as hereinafter pointed out are connected together by studs 20, 40 described below. There is an upstanding lower plate driving element, in the form of a sleeve like socket 16, affixed onto the top surface of the plate 10 so as to rotate together with the plate 10. The socket has a profiled central opening therein for receiving a correspondingly profiled driving shaft 15 (described below). The upper end of the socket 16 has notches 17 formed into it for defining a keyway for the shaft 15.

A main driving shaft 15, which is appropriately shaped, e.g. hexagonally, to fit into the opening at the top of the socket 16, is inserted into the socket. The irregular shape establishes a driving connection between the shaft 15 and the plate 10.

The inserted end portion of the shaft 15 includes keys means **15*b* which are received in the socket notches 17 to assure a driving connection. The shaft 15 includes its end portion 15*a* which is shaped to fit into a three jaw chuck of a hand held drill (not shown). If the entire length of the shaft 15 is profiled, e.g. hexagonally, it will be securely held by the jaws of the chuck. However, if the shaft 15 is round rather than profiled, it can be held in the jaws of the chuck by friction. When the inserted portion of the shaft 15 is round, the opening into socket 16 is correspondingly shaped. Then driving of the stripper will occur because the key means 15*b* are received in the notches 17 to connect the shaft 15, socket 16 and plate 10**.

The lower plate 10 is provided with a plurality of upwardly projecting, fixed studs 20, 21, 22 spaced 120° apart and equally radially spaced from the center shaft 15, as shown in FIG. 2.

Each of the plurality of spring wire stripper members 31, 32, 33, et al. comprises a pair of elongated legs 30, 30, which are integrally connected to support members 30', 30' which, in turn, are connected to and joined by the U-shaped section 30''. Each stripper member thus has the general appearance of a woman's hairpin. Each U-shaped section 30'' of each stripper member is so shaped and arranged that it may be slipped down over one of the studs 20, 21, 22. Each leg 30 is bent with respect to its support member 30' and both legs are bent in the same direction for each spring wire stripper member so that the legs 30 are bent in the trailing direction with respect to rotation of the stripper.

In the assembly of the stripper, the studs 20, 21, 22 are securely connected and integrated with the plate 10. The plate 10 is laid flat and a series of stripper members 31, 32, 33 are individually sequentially slipped over the successive studs 20, 21, 22 so that the respective legs 30 extend out beyond the plate and so that the U-shaped end sections 30'' surround the respective studs 20, 21, 22 so that the support sections 30' pass by and contact both sides of the socket 16 and so that the legs 30 then extend out beyond the plate 10 to define the stripper blades. Another series of spring wire stripper members 31, 32, 33 are successively slipped over the studs 20, 21, 22 so that the fourth such stripper member is slipped over the stud 20, the fifth such stripper member is slipped over the stud 21, and so on with additional series of stripper members until a stripper of an appropriate height is created to match the length of the studs. All of the spring wire stripper members must be applied so that their legs 30 are oriented to trail the rotation of the stripper.

Each of the spring wire stripper members 31, 32, 33, et seq. is supported, by its respective stud 20, 21, 22. Also, the support sections 30' thereof extend past and may be in contact with the sides of the central socket 16. Further out along the sections 30', they are supported against the two other plate studs. For example, the stripper member 31 on stud 20 has its support sections 30' resting against studs 21 and 22. This prevents too great a deflection of the legs 30.

On rotation of the stripper in the direction indicated by the arrow 50 in FIG. 2, each leading leg 30 with respect to rotation of FIG. 2, is, in effect, supported by the central socket 16 but not by the adjacent stud. The trailing leg 30 is supported against too great deflection by the adjacent stud 22.

Since it is possible for the stripper members 31, 32, 33 to be pushed backward or radially toward the periphery of the plate 10 and off the studs 20, 21, 22 retainer studs 40, 41, 42 located radially just outside the studs 20, 21, 22, respectively, are provided on the lower plate 10. The retainer studs 40, 41, 42 bear against the U-shaped sections 30'' of the spring wire stripper members and ensure that these members will not fly out or be pushed out radially toward the periphery of the plate 10. Since the entire assembly of spring wire stripper members is made before the top plate 11 is put into position, there is ready access for the purpose of laying down the succession of the stripper members 31, 32, 33 on the studs 20, 21, 22 despite the close proximity of the studs 40, 41, 42.

When the placing of the spring wire stripper members is completed, the top plate 11 is passed over the shaft extension **15*a* and is secured to the tops of the studs 20, 21, 22. The top plate 11 has a central opening 45 through which the shaft 15 passes. The opening is large enough for the shaft, but too small to permit the socket 16 to pass through it. The socket 16 is of a length to meet the underside of the plate 11. The plate 11 also has openings 46 through it for receiving the upper ends 47 of the studs 20, 21, 22 and openings 48 through it for receiving the ends of the studs 40, 41, 42**.

The stripper may be made in various ways. The stripper wires should, of course, be made of an appropriate flexible metal in order to perform the stripper function. The plates 10 and 11 may, if desired, be comprised of plastic and even the studs 20, 21, 22 and 40, 41, 42 may be comprised of plastic and may in essence be riveted or even "welded" together in order to form an integrated whole. Of course, the top plate 11 may be secured in any suitable manner. All of the elements may alternatively be made of appropriate metal and appropriate riveted, staked or welded connections may be made between the various studs and the plates.

In essences, therefore, the essential element of the present invention is that a plurality of individual two leg spring wire stripper members are laid down sucessively around studs, which are placed 120° apart. In the construction of the stripper, it is preferred that three mounting studs 20, 21, 22 be uniformly placed 120° apart and be appropriately and uniformly spaced from the center of rotation of the plates. In appropriate circumstances, four or five or more such studs may be used. But, this is not believed to be necessary in order to achieve the type of operation here described. Where a larger number of studs are used, then instead of six sets of fingers emerging from the side of the stripper (two sets for each stud), there will be eight, ten or more sets of fingers. Under other circumstances, it may even be possible to use just two studs for the stripper although the drill with which the stripper is used might have to be one which rotates at very high speed to make this type of stripper practical.

In the foregoing, the present invention has been described solely in connection with a preferred illustrative embodiment thereof. Since many variations and modifications of the present invention will now be obvious to those skilled in the art, it is preferred that the scope of the present disclosure be defined not by the specific disclosures herein contained, but only by the appended claims.

What is claimed is:

1. A rotary stripper comprising:

a plate having a periphery, a plate driving element secured to and extending normally of said plate;

a plurality of studs radially spaced from said plate driving element and upstanding from said plate;

at least one stripper member supported by and retained on each said stud; each said stripper member comprising wire means shaped to have two legs and said legs being connected at one end thereof in a sharp bend;

each said stripper member being placed such that said bend thereof passes around and engages a respective said stud on the side of that said stud away from said plate driving element; said legs of said stripper member extending from said bend past said plate driving element, with said plate driving element extending between said legs, and said legs extending beyond said periphery of said plate at the side of said plate away from the respective said stud, whereby each said stripper member defines two said stripper legs for stripping purposes.

2. The rotary stripper of claim 1, wherein said bend is so shaped and said legs are so placed and shaped that each said legs passes by said plate driving element and then normally passes in engagement with a different respective other one of said studs than the respective one engaged by the said bend of that said stripper member; the said other two studs engaged by the two said legs of said stripper member having respective surfaces that are generally opposed to one another and said legs engage the respective said opposed stud surfaces.

3. The rotary stripper of either of claims 1 or 2, wherein for each said stud there is a respective retainer stud upstanding from said plate and spaced closer to said periphery of said plate than said stud; said bend of each said stripper member being positioned between a respective said stud and its said retainer stud.

4. The rotary stripper of claim 1, wherein said studs are uniformly spaced annularly around said plate driving element and are at equal radial distances from said plate driving element.

5. The rotary stripper of any of claims 1, 2 or 4, wherein said stripper members are interleaved with each other such that each successive said stripper member is laid atop the next preceding said stripper member in a stack thereof and successive said stripper members in said stack being mounted on annularly successive said studs, whereby said stripper members are uniformly arrayed annularly around said plate driving element.

6. A rotary stripper of claim 5, wherein there is a plurality of said stripper members on each said stud and each said stripper member on any one said stud is spaced from the adjacent said stripper member on that said stud by a distance equal to the thickness of the said stripper member multiplied by the number of said studs.

7. The rotary stripper of claim 5, wherein for each said stud there is a respective retainer stud upstanding from said plate and spaced closer to said periphery of said plate than said stud; said bend of each said stripper member being positioned between a respective said stud and its said retainer stud.

8. The rotary stripper of claim 2, wherein both said legs also engage said plate driving element as said legs pass by said plate driving element, such that the leading one of said legs of each said stripper member, while said stripper is rotating, extends adjacent to and is supported against excessive angular deflection by said plate driving element and the other trailing one of said legs of each said stripper member extends adjacent to and is supported against excessive angular deflection by one of said studs.

9. The rotary stripper of claim 8, wherein said stripper has three said studs and said legs of each said stripper member engage the said opposed surfaces of two adjacent said studs and said bend is on the third said stud.

10. The rotary stripper of claim 2, wherein said studs are uniformly spaced annularly around said plate driving element and are at equal radial distances from said plate driving element; said stripper members are interleaved with each other such that each successive said stripper member is laid atop the next preceding said stripper member in a stack thereof and successive said stripper members in said stack being mounted on annularly successive said studs, whereby said stripper members are uniformly arrayed annularly around said shaft.

11. The rotary stripper of any of claims 1, 2, 8 or 10, wherein each said stripper member leg is bent in the same direction to cause said leg to trail the direction of rotation of said stripper.

12. The rotary stripper of either claims 1, 2 or 10, further comprising a second plate over and attached on said studs, whereby said stripper members are captured between said plates.

13. The rotary stripper of claim 12, wherein said plate driving element comprises a socket upstanding from the first said plate; said plate driving element further comprising a drive shaft extending from outside said second plate and into said socket and being drivingly connected to said socket, whereby rotation of said drive shaft rotates said socket and said plates.

14. The rotary stripper of claim 4, further comprising a second plate over and attached on said studs, whereby said stripper members are captured between said plates.

15. The rotary stripper of claim 14, wherein said plate driving element comprises a socket upstanding from the first said plate; said plate driving element further comprising a drive shaft extending from outside said second plate and into said socket and being drivingly connected to said socket, whereby rotation of said drive shaft rotates said socket and said plates.

16. The rotary stripper of claim 10, wherein for each said stud, there is a respective retainer stud upstanding from said plate and spaced closer to said periphery of said plate than said stud; said bend of each said stripper member being positioned between a respective said stud and its said retainer stud.

* * * * *